United States Patent [19]

Belverio, Jr. et al.

[11] Patent Number: 4,745,527

[45] Date of Patent: May 17, 1988

[54] ILLUMINATED DOOR LOCK SCRATCH GUARD

[75] Inventors: Joseph L. Belverio, Jr., Verona; David Dennison, Morristown; Gregory Ball, Brookside, all of N.J.

[73] Assignee: Allison Corporation, Livingston, N.J.

[21] Appl. No.: 1,904

[22] Filed: Jan. 9, 1987

[51] Int. Cl.[4] ..... E05B 17/10

[52] U.S. Cl. ..... 362/100; 362/189; 362/800

[58] Field of Search ..... 362/32, 100, 800, 189, 362/201, 205, 157

[56] References Cited

U.S. PATENT DOCUMENTS

| | | | |
|---|---|---|---|
| 2,628,304 | 2/1953 | Boyd | 362/100 |
| 2,765,396 | 10/1956 | Iverson | 362/100 |
| 2,927,197 | 3/1960 | Phillips et al. | 362/100 |
| 3,908,149 | 9/1975 | Gergoe et al. | 362/100 |
| 4,234,909 | 11/1980 | Cotroneo | 362/100 |
| 4,475,067 | 10/1984 | Rowe | 362/100 |
| 4,521,833 | 6/1985 | Wolter | 362/189 |
| 4,524,409 | 6/1985 | Yakubek | 362/189 |
| 4,528,621 | 7/1985 | Hoyt | 362/189 |

*Primary Examiner*—Charles J. Myhre
*Assistant Examiner*—David A. Okonsky
*Attorney, Agent, or Firm*—Helfgott & Karas

[57] ABSTRACT

An illuminated door lock scratch guard formed of a base plate having an aperture. The base plate is mounted onto the door with the aperture in registration with the door lock. An illumination circuit is provided within the base plate, and upon pressure onto the base plate, the illumination circuit casts a light onto the door lock.

8 Claims, 2 Drawing Sheets

FIG. 1
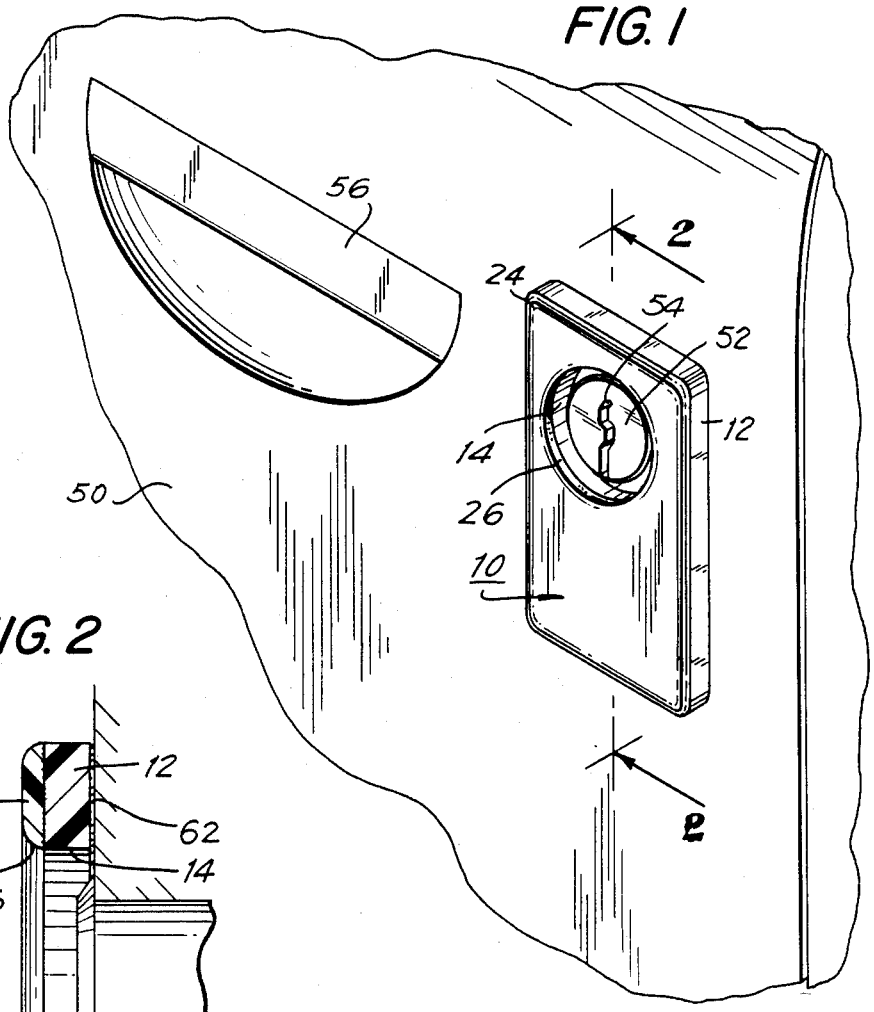
FIG. 2
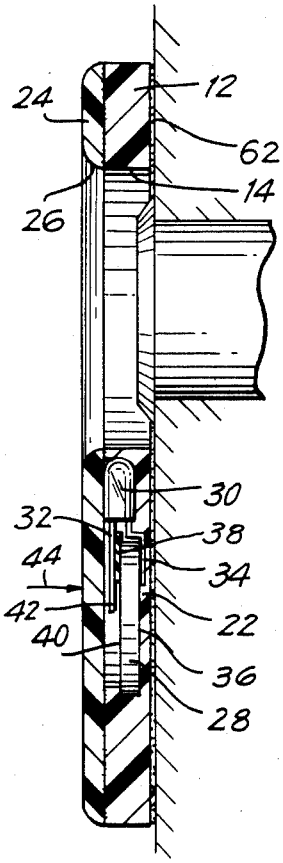
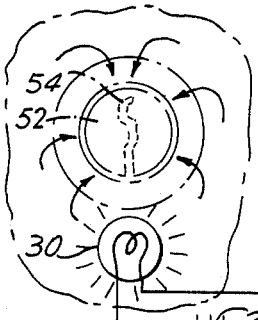
FIG. 4
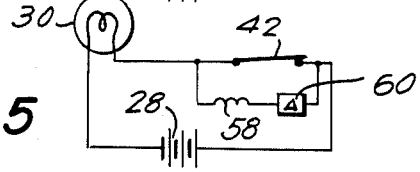
FIG. 5

ILLUMINATED DOOR LOCK SCRATCH GUARD

BACKGROUND OF THE INVENTION

This invention relates to a door lock accessory, and more particularly, to an illuminated scratch guard, which can be mounted about a door lock to protect the lock and surrounding area, and at the same time illuminate the lock to facilitate its use in the dark.

Door locks are typically provided on automobiles, as well as in home use. Especially in the case of automobiles, there is a tendency to scrape the area about the door lock when using the key. As a result, it has been known to attach a scratch guard about the area of the door lock, in order to protect the surrounding area. A similar type of guard element can also be provided around a house door lock, or the like.

In utilizing a door lock, and typically, an automobile door lock, it is difficult to try and find the right spot for insertion of the key into the lock. Especially in a dark area, it may take some time to find the appropriate position in which the key should be inserted. This extra delay in a dark area may result in the automobile user being attacked while trying to open his automobile. Additionally, it may occur that the key will be bent or damaged while trying to insert it inappropriately into the door lock.

Accordingly, there is needed a method of illuminating a door lock in order to facilitate insertion of the key into the lock. Some of the newer model cars have a switch connected to the handle or other part of the door which turns on when manipulated from the exterior of the vehicle, and this provides some means of illumination for the door lock. However, this is limited to only certain models of cars, and especially only the newer models.

It is also frequent for users to carry around small flashlights so that they can illuminate the lock. Such flashlights are occasionally coupled to a key chain, so that as the user takes out the key chain, he has the flashlight available for illuminating the lock while inserting the key.

While these have been provided heretofore, they are either expensive in the case of having them built into the automobile, or inconvenient when the individual has to carry around a flashlight to provide the illumination.

SUMMARY OF THE INVENTION

Accordingly, it is an object of the present invention to provide a means for illuminating the door lock, which avoids the aforementioned problems of prior art devices. Another object of the present invention is to provide an illuminated scratch guard which can be mounted on the door and provides protection for the door lock, and at the same time provide illumination for the door lock.

Still a further object of the present invention is to provide an illuminated scratch guard, which will illuminate the periphery about the door lock in order to permit viewing of the entire lock to facilitate insertion of a key into the lock.

Briefly, in accordance with the present invention, there is provided an illuminated door lock in the form of a scratch guard. The device includes a base plate that can be mounted onto the door and including an aperture in registration with the door lock. An illumination circuit is associated with the base plate for casting illumination onto the door lock through the aperture.

In an embodiment of the invention, a cavity is formed part way through the base plate and receives the circuitry for the illumination. Included within the circuitry is a light emitting device, which projects its light to the aperture. By means of light piping, the light spreads around the interior surface of the aperture wall, thereby illuminating the entire periphery of the door lock. A cover can be provided onto the base plate to protect the internal circuitry.

By pressing onto the exterior of the scratch guard, and typically pressing the cover, an internal switch causes the illumination of the door lock. Such illumination can be maintained only while the cover is being pressed, or a delay element can be built in so that a single depression causes retention of the illumination for a fixed amount of time.

The aforementioned objects, features and advantages of the invention will, in part, be pointed out with particularity, and will, in part, become obvious from the following more detailed description of the invention, taken in conjunction with the accompanying drawing, which forms an integral part thereof.

BRIEF DESCRIPTION OF THE DRAWING

In the drawing:

FIG. 1 is a partially broken away view of an automobile door containing the illuminated scratch guard of the present invention mounted onto the door over the door lock;

FIG. 2 is a cross-sectional view taken along lines 2—2 of FIG. 1 and showing the interior arrangement of the illumination means within the housing of the scratch guard;

FIG. 4 is a schematic circuit diagram in accordance with one embodiment of the present invention; and FIG. 5 is a schematic circuit diagram of an alternate embodiment of the present invention.

In the various figures of the drawing like reference characters designate like parts.

DESCRIPTION OF THE PREFERRED EMBODIMENT

Figure 3:
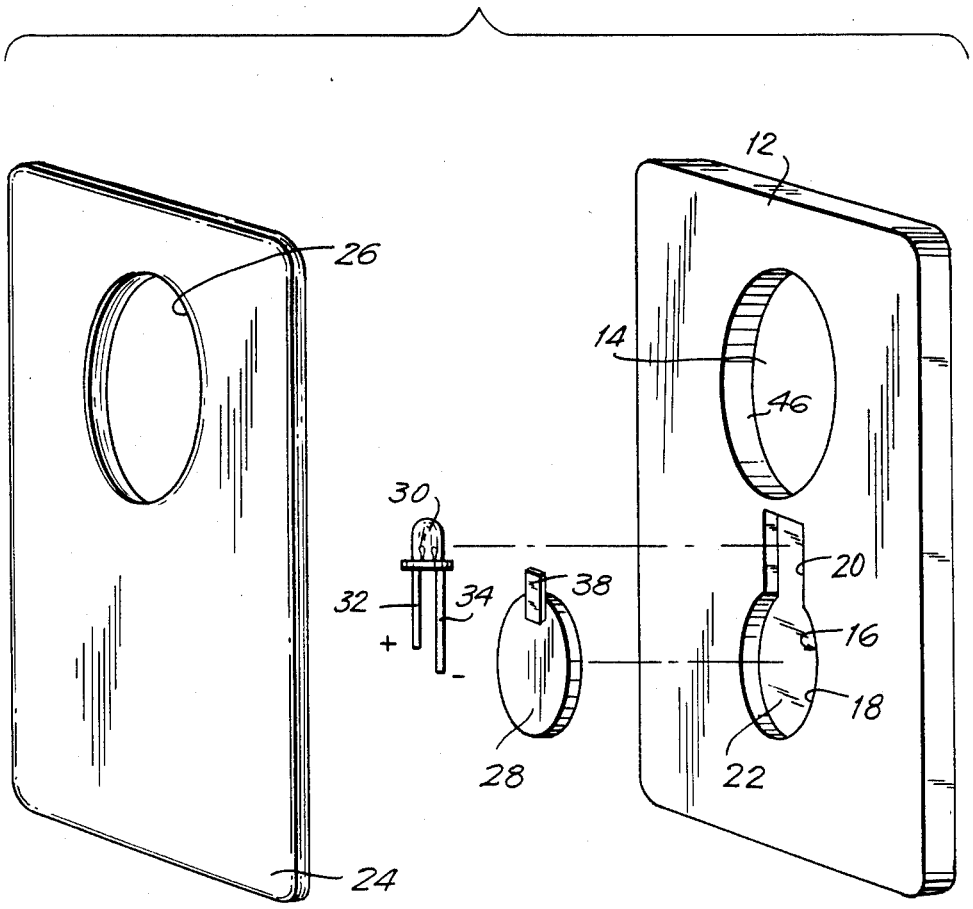
FIG. 3 is an exploded view of the various elements forming the illuminated scratch guard of the present invention.

Referring now to FIGS. 1–3, the scratch guard of the present invention is shown generally at 10, and is formed of a base plate 12, having a central aperture 14 formed entirely therethrough. A cavity 16 in the form of a keyway is formed partially through the base plate 12 in the lower portion thereof. The keyway includes a circular cut out 18 and an upwardly extending tongue 20. A back wall 22 prevents entire penetration of the keyway through the base plate 12. The base plate can be formed of a hard plastic material. Covering the base plate is a cover member 24, which can be in the form of a softer plastic material. A corresponding aperture 26 is provided in the cover plate 24 in registration with the aperture 14 in the base plate.

Positioned within the cavity 16 is the circuitry for providing illumination. The circuit includes a battery 28, typically a 3-volt lithium battery, or its equivalent. Also provided is a light emitting diode 30 having a pair of depending contact legs 32, 34. The battery would fit into the circular portion 18 of the keyway, and the light emitting diode would fit within the tongue portion 20 with the illuminating part thereof 30 extending upward and adjacent the aperture 14, as best shown in FIG. 2.

In mounting the circuit elements, the battery is positioned so that one of the arms 34 is placed beneath the battery and in continuous contact with the face 36 of the battery. The other contact 32 is spaced from the battery by means of an insulating strip 38. However, the insulating strip does not extend entirely between the contact 32 and the face 40 of the battery, but only extends part way therebetween. This leaves a cantilevered portion 42 of the contact 32 spaced from the face 40 of the battery. As a result, depression on the front surface of the cover member 24, as shown by the arrow 44, will cause the cantilevered portion 42 of the contact 32 to touch the surface 40 of the battery, thereby completing a circuit from one side of the battery 36 through the contact arm and the light emitting portion 30 and back through the arm 32 to the other side 40 of the battery. The light emitting device 30 will thereby illuminate.

Upon illumination of the light emitting device, the light will spread along the interior surface 46 of the aperture 14, as shown in FIG. 3. The surface 46 will effectively serve as a light pipe transmitting the light entirely around the periphery of the aperture.

Referring to FIG. 1, in operation, the scratch guard 10 is mounted onto the door 50 of the automobile, so that the apertures 14 and 26 are in registration with a door lock 52 provided on the automobile door. The lock is typically adjacent to the handle portion 56. Upon depression of the cover portion 24, the light will illuminate the entire interior surface about the apertures to illuminate the lock 52 and the keyway 54 provided in the lock.

As shown in FIG. 4, the circuit can be a simple circuit, including the battery 28 in series with the light emitting diode 30. The switch portion 42 is shown as a simple single pole switch schematically representing the end of the contact which touches onto the surface of the battery.

With the circuit as shown in FIG. 4, so long as the switch 42 is depressed by applying constant pressure onto the surface 24 of the scratch guard, the light will continue to illuminate. An alternate embodiment, is shown in FIG. 5, where again there is provided the battery 28 in series with the light emitting device 30. In this circuit, the switch 42 is in series with a electromagnetic element 58 and a delay 60. By means of this circuit, once the switch 42 is closed, the electromagnet 58 will be energized to continuously retain the switch 42 in a closed position, even though the switch is not held closed by manual pressure onto the surface. The switch will remain closed so long as the electromagnet 58 is energized. This will depend upon the length of time provided on the delay 60. After the delay time has been reached, the electromagnet 58 is de-energized, thereby releasing the switch 42. With the circuit of FIG. 5, a single depression will cause the illumination to stay on for a given amount of time, during which the individual can manipulate the lock.

The illuminated scratch guard can be held in place by means of adhesive 62 mounted on the back surface of the base plate which can cover the entire back area, except the aperture 14.

It should be appreciated, that other types of circuit arrangements could similarly be included which could carry out the features of the present invention. With the present invention, however, the battery and the light emitting diode are completely and permanently sealed within the housing and cannot be accessed for manipulation and damage.

It should also be appreciated, that although the light emitting device is provided within the scratch guard, the light only serves to illuminate the lock and does not illuminate the entire device itself.

There has been disclosed heretofore the best embodiment of the invention presently contemplated. However, it is to be understood that various changes and modifications may be made thereto, without departing from the spirit of the invention.

What is claimed is:

1. An illuminated door lock scratch guard, comprising a base plate means having an aperture therein, said plate means mounting onto a door with the aperture in registration with the door lock; illumination means associated with the plate means for casting illumination onto the door lock, a cavity formed in said plate means for accommodating said illumination means, said cavity including a channel approaching said aperture, wherein said illumination means further includes a pressure type switch within said plate means and a battery in said plate means, whereby pressing onto the plate means turns on said illumination means, and said scratch guard being formed as an assembly being mounted onto the door as a separate unit.

2. An illuminated door lock scratch guard as in claim 1, wherein said illumination means includes hold and delay means, whereupon a single depression onto the base plate means turns on the illumination means for a pre-set time.

3. An illuminated door lock scratch guard as in claim 1, and comprising a portion of said base plate as a solid bridge between said channel and said aperture, wherein the light from the illumination means spreads along the interior of said aperture to travel about said aperture and thereby illuminate the entire periphery of the door lock without illuminating the entire base plate.

4. An illuminated door lock scratch guard as in claim 1, wherein said plate means comprises a rigid plastic base member and a soft plastic cover member, and wherein said cavity is formed part way through from one surface of the base member and said cover member covers said cavity.

5. An illuminated door lock scratch guard as in claim 1, wherein said illumination means comprises a light emitting device in said plate means, a contact coupled between said light emitting device and said battery, and a second contact from said light emitting device and spaced from said battery, whereupon pressing onto said plate means causes said second contact to touch said battery, thereby completing the circuit for illuminating the light emitting device.

6. An illuminated door lock scratch guard as in claim 5, and comprising insulating means separating a portion of said second contact from said battery, said second contact being cantilevered over the battery beyond said insulating means.

7. An illuminated door lock scratch guard as in claim 1, wherein said plate means comprises a rigid plastic base member and a soft plastic cover member.

8. An illuminated door lock scratch guard as in claim 7, and comprising adhesive material on the bottom of said base member.

* * * * *